US011698083B2

(12) United States Patent
Wei

(10) Patent No.: US 11,698,083 B2
(45) Date of Patent: Jul. 11, 2023

(54) ELECTRIC CENTRIFUGAL PUMP

(71) Applicant: GUANGDONG JUNCHI SCIENCE AND TECHNOLOGY CO., LTD., Zhaoqing (CN)

(72) Inventor: Xiuxia Wei, Zhaoqing (CN)

(73) Assignee: GUANGDONG JUNCHI SCIENCE AND TECHNOLOGY CO., LTD., Zhaoqing (CN)

( * ) Notice: Subject to any disclaimer, the term of this patent is extended or adjusted under 35 U.S.C. 154(b) by 451 days.

(21) Appl. No.: 17/049,388

(22) PCT Filed: Jan. 3, 2020

(86) PCT No.: PCT/CN2020/070243

§ 371 (c)(1),
(2) Date: Oct. 21, 2020

(87) PCT Pub. No.: WO2020/248595

PCT Pub. Date: Dec. 17, 2020

(65) Prior Publication Data

US 2023/0151822 A1 May 18, 2023

(30) Foreign Application Priority Data

Jun. 13, 2019 (CN) ..... 201910510242.8

(51) Int. Cl.
*F04D 29/42* (2006.01)
*F04D 13/06* (2006.01)
(Continued)

(52) U.S. Cl.
CPC ..... *F04D 29/426* (2013.01); *F04D 13/026* (2013.01); *F04D 13/06* (2013.01);
(Continued)

(58) Field of Classification Search
CPC ..... F04D 29/426; F04D 13/026; F04D 13/06; F04D 13/0606; F04D 13/0613;
(Continued)

(56) References Cited

U.S. PATENT DOCUMENTS 3,135,213 A * 6/1964 Smith ..... F04D 29/061 310/90
3,897,178 A * 7/1975 Palloch ..... F04D 13/06 417/369

(Continued)

FOREIGN PATENT DOCUMENTS

CN 104675711 A 6/2015
CN 206175322 U 5/2017

(Continued)

OTHER PUBLICATIONS

International Search Report from PCT/CN2020/070243, dated Mar. 26, 2020 (5 pages).

(Continued)

*Primary Examiner* — Peter J Bertheaud
(74) *Attorney, Agent, or Firm* — Ware, Fressola, Maguire & Barber LLP

(57) ABSTRACT

An electric centrifugal pump includes a water pump shell, a water sealing bearing, a water pump impeller, a spring washer, an inner motor cover, a bearing pedestal, a front rotor bearing, a motor stator, a motor rotor, a shaft of the motor rotor, a rear bearing of the motor rotor, a leading impeller, a leading impeller cover, a water pump driving control panel, a controller cover and a motor shell, and an internal forced cooling system is formed by the water inlet cavity of the water pump, an axial through hole of the shaft of the motor rotor, the leading impeller, a leading impeller cavity of the leading impeller, a spiral overflowing hole of the inner motor cover, a rotor cavity, a spiral overflowing
(Continued)

hole of the bearing pedestal and the water pump impeller which are sequentially communicated.

8 Claims, 3 Drawing Sheets

(51) Int. Cl.

| | |
|---|---|
| ***F04D 29/046*** | (2006.01) |
| ***F04D 29/58*** | (2006.01) |
| ***F04D 13/02*** | (2006.01) |
| ***F04D 29/043*** | (2006.01) |
| ***F04D 29/06*** | (2006.01) |

(52) U.S. Cl.
CPC ..... *F04D 13/0606* (2013.01); *F04D 13/0613* (2013.01); *F04D 13/0633* (2013.01); *F04D 13/0646* (2013.01); *F04D 29/043* (2013.01); *F04D 29/046* (2013.01); *F04D 29/061* (2013.01); *F04D 29/5806* (2013.01); *F04D 29/588* (2013.01); *F04D 29/5813* (2013.01)

(58) Field of Classification Search
CPC ..... F04D 13/0633; F04D 13/0646; F04D 29/043; F04D 29/046; F04D 29/061; F04D 29/5806; F04D 29/5813; F04D 29/588
See application file for complete search history.

(56) References Cited

U.S. PATENT DOCUMENTS

| | | | | |
|---|---|---|---|---|
| 4,013,384 | A * | 3/1977 | Oikawa | F04D 29/0413 415/10 |
| 4,047,847 | A * | 9/1977 | Oikawa | F04D 13/025 417/370 |
| 5,009,578 | A * | 4/1991 | Hyland | F04D 29/0416 417/370 |
| 9,422,936 | B2 * | 8/2016 | Park | F01P 5/12 |
| 10,323,654 | B2 * | 6/2019 | Zhang | F04D 13/0646 |
| 2013/0216355 | A1 | 8/2013 | Park et al. | |

FOREIGN PATENT DOCUMENTS

| | | |
|---|---|---|
| CN | 109854540 A | 6/2019 |
| CN | 109861459 A | 6/2019 |
| CN | 110159548 A | 8/2019 |

OTHER PUBLICATIONS

Written Opinion from PCT/CN2020/070243, dated Mar. 23, 2020 (7 pages).

* cited by examiner

ELECTRIC CENTRIFUGAL PUMP

CROSS-REFERENCE TO RELATED APPLICATIONS

This application is a national stage filing under 35 U.S.C. § 371 of international application number PCT/CN2020/070243, filed Jan. 3, 2020, which claims priority to Chinese patent application No. 201910510242.8 filed Jun. 13, 2019. The contents of these applications are incorporated herein by reference in their entirety.

FIELD

The present disclosure relates to a centrifugal pump, and more particularly, to an electric centrifugal pump applied to an automobile cooling system.

BACKGROUND

Cooling water pumps applied to automobile cooling systems are basically centrifugal water pumps. With the development of an electric automobile, power components such as a driving motor and a power battery of the electric automobile need to be cooled by a cooling system to ensure a working performance and a working reliability thereof. The cooling system of the electric automobile does not have a mechanical water pump driven by the engine of a traditional fuel automobile, and an electric cooling water pump driven by electric power becomes the first choice. The problem of heat generation may occur in the motor and the motor controller driving the motor to work during working, overheating of a rotor may lead to demagnetization of the permanent magnet, overheating of a stator may lead to burnout of coil insulation, and overheating of a controller may lead to burnout of a component of the controller. Thus, it can be seen that heat load is a major problem to be solved for the electric water pump. A cooling mode used by the existing electric water pump includes leading a small amount of water from a high-pressure water cavity of the water pump to a rotor cavity, and leading the internal cooling water to flow out from a water inlet of a water pump impeller, which may cause certain flow loss, lift loss and electric energy loss. Due to the flow loss and the lift loss, it is impossible to use a large flow of water for internal cooling, and after the internal cooling water flowing out from the water inlet of the water pump impeller is pumped to the high-pressure cavity, a part of the internal cooling water with increased temperature may enter an internal cooling water channel again, resulting in a poor cooling effect. However, some electric water pumps even use immersion cooling that the internal cooling water does not flow, so that the internal heat cannot be dissipated well, and the cooling effect is poor, thus having a great potential reliability risk.

SUMMARY

Aiming at the defects in the prior art, the present disclosure provides a low-loss electric centrifugal pump with a high reliability and a good heat dissipation effect.

In order to achieve the above technical solution, the present disclosure provides an electric centrifugal pump, which includes a motor shell with an inner cavity hole in which a motor stator is installed, and a water pump shell installed on a front end surface of the motor shell, wherein the electric centrifugal pump further includes an inner motor cover, a rear end of the inner motor cover penetrates through an inner hole of an iron core of the motor stator to stretch to a rear end of the inner cavity of the motor shell, the rear end of the inner motor cover is provided with an installation hole for installing a rear bearing of the motor rotor and a spiral overflowing hole, the rear bearing of the motor rotor is installed in the bearing installation hole arranged at the rear end of the inner motor cover, a chamfer is arranged at a front end opening of an inner cavity of the inner motor cover, an outside of a bearing pedestal is made into a conical surface, the conical surface of the outside of the bearing pedestal abuts against the chamfer at the front end opening of the inner cavity of the inner motor cover, the bearing pedestal is provided with an installation hole for installing a front bearing of the motor rotor and a spiral overflowing hole, the front bearing of the motor rotor is installed in the bearing installation hole arranged in the bearing pedestal, a shaft of the motor rotor is installed between the front bearing of the motor rotor and the rear bearing of the motor rotor, the motor rotor is fixed on the shaft of the motor rotor and located in a rotor cavity formed by the motor stator, a front end of the shaft of the motor rotor extends out of a front end surface of the front bearing of the motor rotor to stretch into an inner water inlet cavity of the water pump shell, a water pump impeller is tightly fixed on a front end journal of the shaft of the motor rotor through a water pump impeller insert, a water sealing bearing for isolating high and low pressure water cavities is arranged at an inner water inlet of the water pump shell, a boss in a circle is arranged on an edge of a front end center hole of the water pump impeller, a front end surface of the boss at a front end of the water pump impeller abuts against an end surface of an inner bearing ring of the water sealing bearing to isolate the high and low pressure water cavities, an axial portion of the shaft of the motor rotor is provided with a through hole penetrating through front and rear ends of the whole shaft of the motor rotor, a rear end of the shaft of the motor rotor extends out of a rear end surface of the rear bearing of the motor rotor to stretch to a leading impeller cavity enclosed by the rear end of the inner motor cover and the inner cavity of the motor shell, and a leading impeller is tightly fixed on a rear end journal of the shaft of the motor rotor through a leading impeller insert and located in the leading impeller cavity, wherein an internal forced cooling system is formed by the water inlet cavity of the water pump, an axial through hole of the shaft of the motor rotor, the leading impeller, the leading impeller cavity of the leading impeller, the spiral overflowing hole of the inner motor cover, the rotor cavity, the spiral overflowing hole of the bearing pedestal and the water pump impeller which are sequentially communicated.

Preferably, a water pump driving control panel is installed in a counter bore at the rear end of the motor shell and protected by blocking with a controller cover, and a bottom surface of the water pump driving control panel is closely attached to a bottom surface of the counter bore at the rear end of the motor shell.

Preferably, a raised tubular lap is arranged at a center of a bottom portion of the inner cavity of the motor shell, a spiral lap is arranged in an inner cavity of the tubular lap, a rabbet is arranged at an opening of the inner cavity of the motor shell, an end surface flange is arranged at the front end of the inner motor cover, and the front end flange of the inner motor cover is installed in the rabbet at the opening of the inner cavity of the motor shell.

Preferably, a sealing ring is arranged between the inner motor cover and the tubular lap in the inner cavity of the motor shell.

Preferably, the water pump shell is fixed on the front end surface of the motor shell in a bolt fastening mode and sealed by a sealing washer.

Preferably, sealing covers are arranged at the front and rear ends of the water sealing bearing.

Preferably, a spring washer is arranged between the rear end of the water pump impeller and the front end surface of the front bearing of the motor rotor.

Preferably, a leading impeller cover is arranged in a rear end opening of the leading impeller.

The electric centrifugal pump provided by the present disclosure has the beneficial effects as follows. The electric centrifugal pump is simple in structure and ingenious in design. In an actual working process, the pumping of the leading impeller further increases a cooling flow of the internal cooling water on the basis of the pumping of the water pump impeller, rotating movements of the leading impeller and the motor rotor drive the cooling water in the cavity to rotate, the spiral bevel of the spiral lap at the bottom portion of the inner cavity of the motor shell pushes the rotating water flow in the leading impeller cavity to the rotor cavity, a spiral flowing channel of the inner motor cover and a spiral flowing channel of the bearing pedestal arranged along a water flow track effectively reduce a flowing resistance of the internal water flow, and from the water inlet in the water pump shell to the high-pressure water cavity where water is pumped in by the water pump impeller through an internal cooling flowing channel and the water outlet of the water pump, the water flow of the internal cooling system takes away the absorbed internal heat with the water flow pumped out by the water pump, the water flow of the internal cooling system does not have a backflow loss, a flow rate of the internal cooling water flow can be increased and a flow resistance of the internal cooling water flow can be reduced by setting the overflowing hole, so that the flow loss of water flow is reduced, while the cooling effect of the internal cooling system is improved, thus solving the heat load problem of the electric centrifugal pump well, and improving the working reliability of the electric centrifugal pump.

Figure 1:
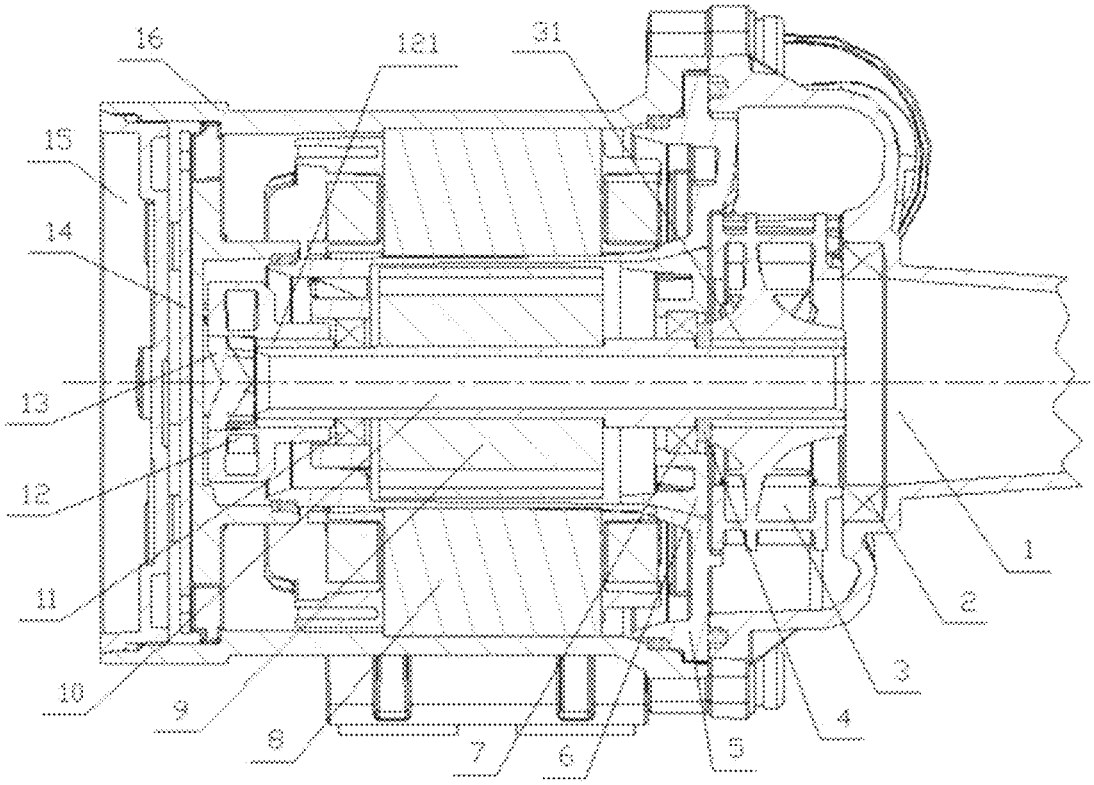
FIG. 1 is a cross-section view of a structure of the present disclosure.

In the drawings: 1 refers to water pump shell; 2 refers to water sealing bearing; 3 refers to water pump impeller; 31 refers to water pump impeller insert; 4 refers to spring washer; 5 refers to inner motor cover; 51 refers to bearing installation hole of inner motor cover; 52 refers to spiral overflowing hole of inner motor cover; 53 refers to front end flange of inner motor cover; 6 refers to bearing pedestal; 61 refers to bearing installation hole of bearing pedestal; 62 refers to spiral overflowing hole of bearing pedestal; 7 refers to front rotor bearing; 8 refers to motor stator; 9 refers to motor rotor; 10 refers to shaft of motor rotor; 11 refers to rear bearing of motor rotor; 12 refers to leading impeller; 121 refers to leading impeller insert; 13 refers to leading impeller cover; 14 refers to water pump driving control panel; 15 refers to controller cover; 16 refers to motor shell; 161 refers to tubular lap; 162 refers to spiral lap; and 163 refers to rabbet.

DETAILED DESCRIPTION OF THE EMBODIMENTS

The technical solutions in the embodiments of the present disclosure will be clearly and completely described below with reference to the accompanying drawings in the embodiments of the present disclosure. Apparently, the described embodiments are only some but not all of the embodiments of the present disclosure. All other embodiments obtained by those skilled in the art without going through any creative work should all fall within the scope of protection of the present disclosure.

Figure 2:
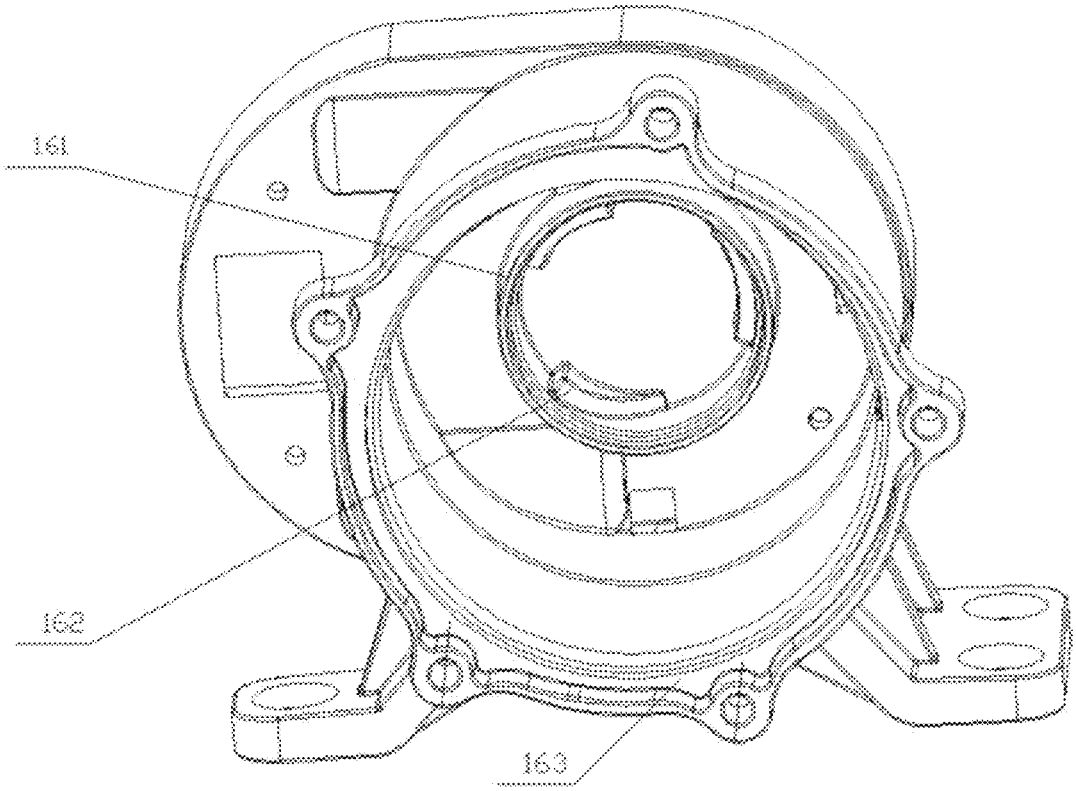
FIG. 2 is a stereoscopic structure diagram of a motor shell in the present disclosure.
Figure 3:
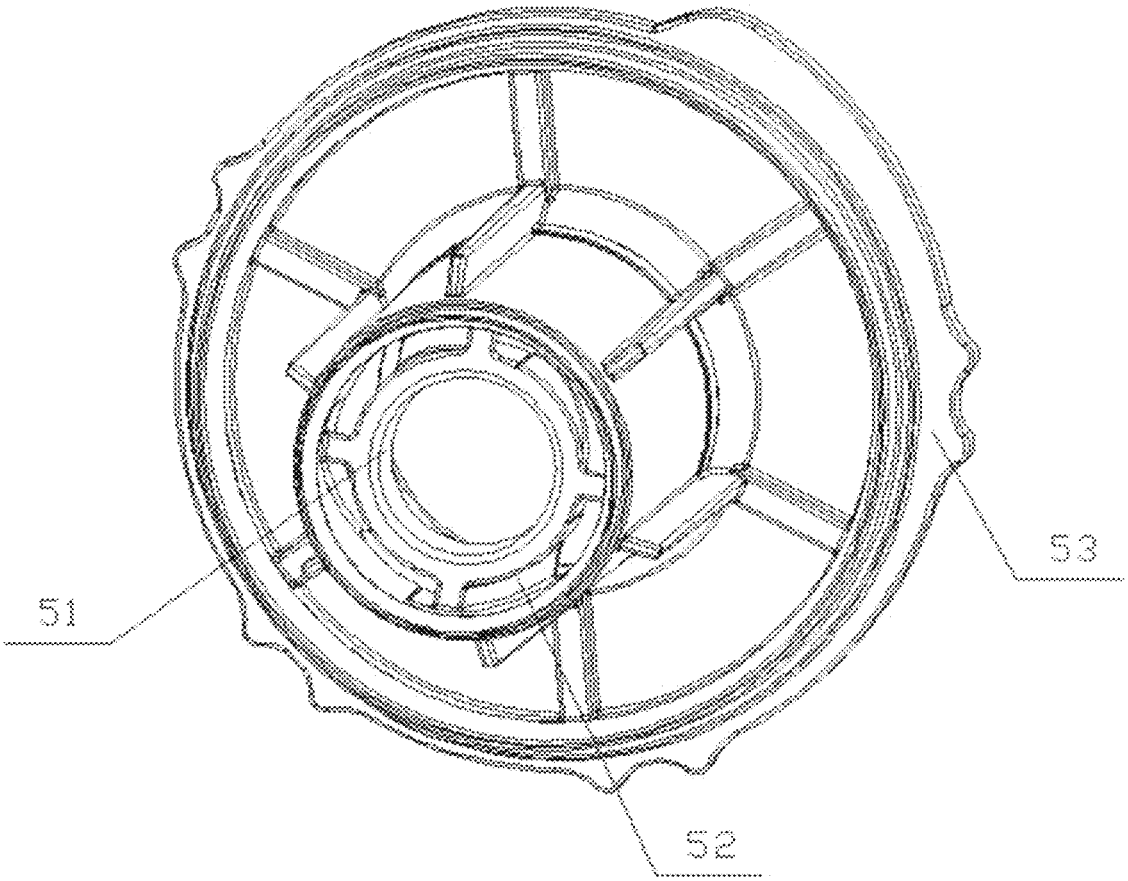
FIG. 3 is a stereoscopic structure diagram of an inner cover in the present disclosure.
Figure 4:
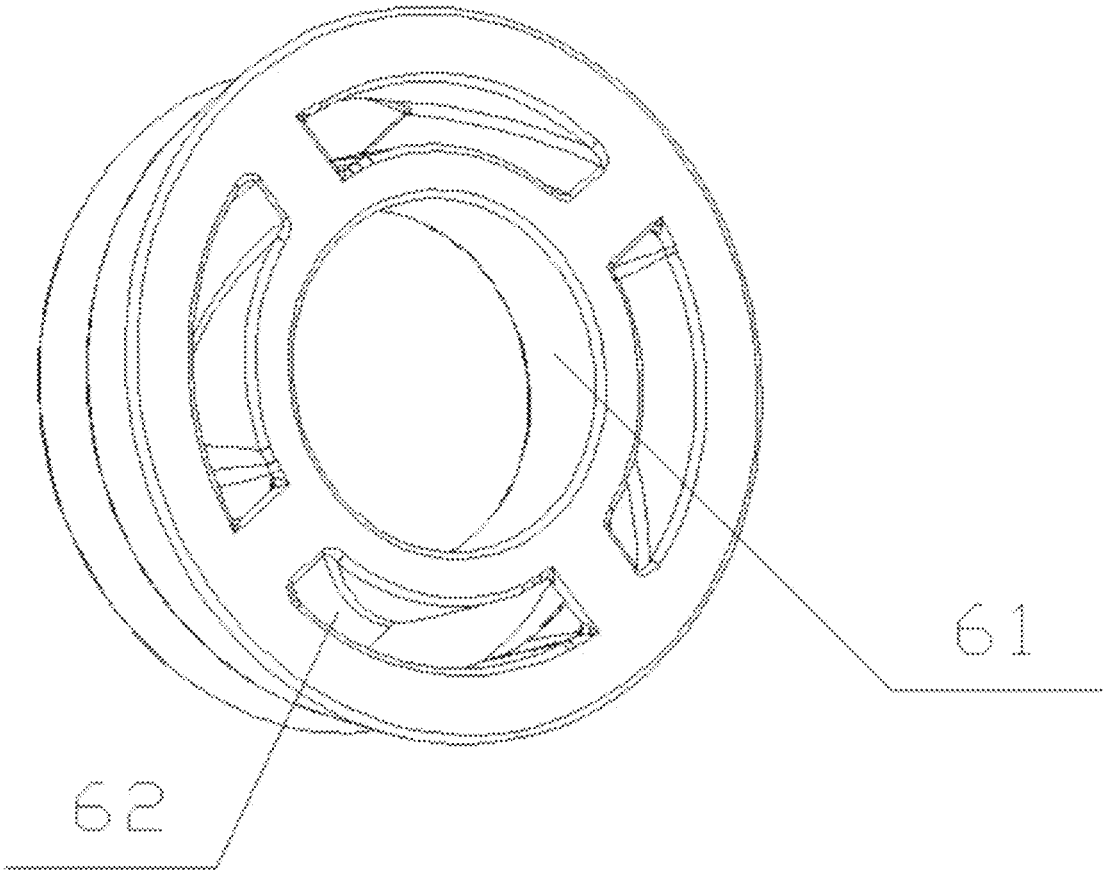
FIG. 4 is a stereoscopic structure diagram of a bearing pedestal in the present disclosure.

With reference to FIG. 1 to FIG. 4, an electric centrifugal pump includes a water pump shell 1, a water sealing bearing 2, a water pump impeller 3, a spring washer 4, an inner motor cover 5, a bearing pedestal 6, a front rotor bearing 7, a motor stator 8, a motor rotor 9, a shaft 10 of the motor rotor 9, a rear bearing 11 of the motor rotor 9, a leading impeller 12, a leading impeller cover 13, a water pump driving control panel 14, a controller cover 15 and a motor shell 16. A raised tubular lap 161 is arranged at a center of a bottom portion of an inner cavity of the motor shell 16, a spiral lap 162 is arranged in an inner cavity of the tubular lap 161, and a rabbet 163 is arranged at an opening of the inner cavity of the motor shell 16. The motor stator 8 is installed in an inner cavity hole of the motor shell 16. The inner motor cover 5 is integrally formed by an inner motor end cover and a sleeve of the motor rotor 9. A rear end of the inner motor cover 5 penetrates through an inner hole of an iron core of the motor stator 8 to stretch to a rear end of the inner cavity of the motor shell 16, and a sealing ring is arranged between the inner motor cover 5 and the tubular lap 161 in the inner cavity of the motor shell 16 for sealing. The rear end of the inner motor cover 5 is provided with a bearing installation hole 51 of the inner motor cover 5 and a spiral overflowing hole 52 of the inner motor cover 5, and a rear bearing 11 of the motor rotor 9 is installed in the bearing installation hole 51 of the inner motor cover 5. An end surface flange 53 is arranged at the front end of the inner motor cover 5, and the front end flange 53 of the inner motor cover 5 is installed in the rabbet 163 at the opening of the inner cavity of the motor shell 16. A chamfer is arranged at a front end opening of an inner cavity of the inner motor cover 5, an outside of the bearing pedestal 6 is made into a conical surface, and the conical surface of the outside of the bearing pedestal 6 abuts against the chamfer at the front end opening of the inner cavity of the inner motor cover 5. The bearing pedestal 6 is provided with a bearing installation hole 61 of the bearing pedestal 6 and a spiral overflowing hole 62 of the bearing pedestal 6, and the front bearing 7 of the motor rotor 9 is installed in the bearing installation hole 61 of the bearing pedestal 6. A front journal of the shaft 10 of the motor rotor 9 is sleeved in the bearing hole of the front bearing 7 of the motor rotor 9, and a front end of the shaft 10 of the motor rotor 9 extends out of a front end surface of the front bearing 7 of the motor rotor 9 to stretch into an inner water inlet cavity of the water pump shell 1. The motor rotor 9 fixed on the shaft 10 is installed in the inner cavity of the inner motor cover 5. The water pump shell 1 is installed on the motor shell 16 in a bolt fastening mode and sealed by a sealing washer. A water sealing bearing 2 for isolating high and low pressure water cavities is arranged at an inner water inlet of the water pump shell 1, and sealing covers are arranged at the front and rear ends of the water sealing bearing 2. The water pump impeller 3 is provided with a water pump impeller insert 31, and the water pump impeller 3 is tightly fixed on the front end journal of the shaft 10 of the motor rotor 9 through the water pump impeller insert 31. A spring washer 4 is arranged between the rear end of the water pump impeller 3 and the front end surface of the front bearing 7 of the motor rotor 9. A boss in a circle is arranged on an edge of a front end center hole of the water pump impeller 3, and a front end surface of the boss at a front end of the water pump impeller 3 abuts against an end surface of an inner bearing ring of the water sealing bearing 2 to isolate the high and low pressure water cavities. An axial tension of the spring washer 4 enables the front end surface of the boss at the front end of the water pump impeller 3 to attach to the end surface of the inner bearing ring of the water sealing bearing 2, and the axial tension of the spring washer 4 enables the front bearing 7 of the motor rotor 9 and the bearing pedestal 6 provided with the front bearing 7 of the motor rotor 9 to be located on an installation position. An axial portion of the shaft 10 of the motor rotor 9 is provided with a through hole penetrating through front and rear ends of the whole shaft 10 of the motor rotor 9, and a rear journal of the shaft 10 of the motor rotor 9 is sleeved in the bearing hole of the rear bearing 11 of the motor rotor 9. A rear end of the shaft 10 of the motor rotor 9 extends out of a rear end surface of the rear bearing 11 of the motor rotor 9 to stretch to a leading impeller cavity enclosed by the rear end of the inner motor cover 5 and the tubular lap 161 of the inner cavity of the motor shell 16. The leading impeller 12 is provided with a leading impeller insert 121, and the leading impeller 12 is tightly fixed on a rear end journal of the shaft 10 of the motor rotor 9 through the leading impeller insert 121. The leading impeller cover 13 is arranged in a rear end opening of the leading impeller 12. The water pump driving control panel 14 is installed in a counter bore at the rear end of the motor shell 16 and protected by blocking with the controller cover 15, and a bottom surface of the water pump driving control panel 14 is closely attached to a bottom surface of the counter bore at the rear end of the motor shell 16.

In the embodiment, an internal forced cooling system is formed by the water inlet cavity of the water pump, an axial through hole of the shaft 10 of the motor rotor 9, the leading impeller 12, a leading impeller cavity, the spiral overflowing hole 52 of the inner motor cover 5, a rotor cavity, the spiral overflowing hole 62 of the bearing pedestal 6 and the water pump impeller 3 which are sequentially communicated. In an actual working process, the pumping of the leading impeller 12 further increases cooling flow of the internal cooling water on the basis of the pumping of the water pump impeller 3. The leading impeller cover 13 installed on the leading impeller 12 prevents the water pumped by the leading impeller 12 from flowing back into the water inlet of the leading impeller 12. Rotating movements of the leading impeller 12 and the motor rotor 9 drive the cooling water in the cavity to rotate, the spiral bevel of the spiral lap 162 at the bottom portion of the inner cavity of the motor shell 16 pushes the rotating water in the leading impeller cavity to the rotor cavity, the spiral overflowing hole 52 of the inner motor cover 5 and the spiral overflowing hole 62 of the bearing pedestal 6 arranged along a water flow track effectively reduce a flowing resistance of the internal water flow, and from the water inlet in the water pump shell 1 to the high-pressure water cavity where water is pumped in by the water pump impeller 3 through an internal cooling flowing channel and the water outlet of the water pump, the water flow of the internal cooling system takes away the absorbed internal heat with the water flow pumped out by the water pump. The water flow of the internal cooling system does not have a backflow loss, a flow rate of the internal cooling water flow can be increased and a flow resistance of the internal cooling water flow can be reduced by using the overflowing hole with a large hole diameter, so that the flow loss of the water flow is reduced, while the cooling effect of the internal cooling system is improved, thus solving the heat load problem of the electric centrifugal pump well, and improving the working reliability of the electric centrifugal pump.

The above are only preferred embodiments of the present disclosure, but the present disclosure should not be limited to the contents disclosed in the embodiments and the accompanying drawings. Therefore, all equivalents or modifications that can be completed without departing from the principle disclosed by the present disclosure fall into the scope of protection of the present disclosure.

What is claimed:

1. An electric centrifugal pump, comprising a motor shell with an inner cavity hole in which a motor stator is installed, and a water pump shell installed on a front end surface of the motor shell, wherein the electric centrifugal pump further comprises an inner motor cover, a rear end of the inner motor cover penetrates through an inner hole of an iron core of the motor stator to stretch to a rear end of an inner cavity of the motor shell, the rear end of the inner motor cover is provided with an installation hole for installing a rear bearing of a motor rotor and a spiral overflowing hole, the rear bearing of the motor rotor is installed in the bearing installation hole arranged at the rear end of the inner motor cover, a chamfer is arranged at a front end opening of an inner cavity of the inner motor cover, an outside of a bearing pedestal comprising a conical surface, the conical surface of the outside of the bearing pedestal abuts against the chamfer at the front end opening of the inner cavity of the inner motor cover, the bearing pedestal is provided with a further installation hole for installing a front bearing of the motor rotor and a spiral overflowing hole, the front bearing of the motor rotor is installed in the further installation hole arranged in the bearing pedestal, a shaft of the motor rotor is installed between the front bearing of the motor rotor and the rear bearing of the motor rotor, the motor rotor is fixed on the shaft of the motor rotor and located in a rotor cavity formed by the motor stator, a front end of the shaft of the motor rotor extends out of a front end surface of the front bearing of the motor rotor to stretch into an inner water inlet cavity of the water pump shell, a water pump impeller is tightly fixed on a front end journal of the shaft of the motor rotor through a water pump impeller insert, a water sealing bearing for isolating high and low pressure water cavities is arranged at an inner water inlet of the water pump shell, a boss in a circle is arranged on an edge of a front end center hole of the water pump impeller, a front end surface of the boss at a front end of the water pump impeller abuts against an end surface of an inner bearing ring of the water sealing bearing to isolate the high and low pressure water cavities, an axial portion of the shaft of the motor rotor is provided with a through hole penetrating through front and rear ends of the whole shaft of the motor rotor, the rear end of the shaft of the motor rotor extends out of a rear end surface of the rear bearing of the motor rotor to stretch to a leading impeller cavity enclosed by the rear end of the inner motor cover and the inner cavity of the motor shell, and a leading impeller is tightly fixed on a rear end journal of the shaft of the motor rotor through a leading impeller insert and located in the leading impeller cavity, wherein an internal forced cooling system is formed by the inner water inlet cavity of the water pump shell, the axial through hole of the shaft of the motor rotor, the leading impeller, the leading impeller cavity of the leading impeller, the spiral overflowing hole of the inner motor cover, the rotor cavity, the spiral overflowing hole of the bearing pedestal and the water pump impeller which are sequentially communicated.

2. The electric centrifugal pump of claim 1, wherein a water pump driving control panel is installed in a counter bore at the rear end of the motor shell and protected by blocking with a controller cover, and a bottom surface of the water pump driving control panel is closely attached to a bottom surface of the counter bore at the rear end of the motor shell.

3. The electric centrifugal pump of claim 1, wherein a raised tubular lap is arranged at a center of a bottom portion of the inner cavity of the motor shell, a spiral lap is arranged in an inner cavity of the tubular lap, a rabbet is arranged at an opening of the inner cavity of the motor shell, an end surface flange is arranged at the front end of the inner motor cover, and the end surface flange is installed in the rabbet at the opening of the inner cavity of the motor shell.

4. The electric centrifugal pump of claim 3, wherein a sealing ring is arranged between the inner motor cover and the tubular lap in the inner cavity of the motor shell.

5. The electric centrifugal pump of claim 1, wherein the water pump shell is fixed on the front end surface of the motor shell in a bolt fastening mode and sealed by a sealing washer.

6. The electric centrifugal pump of claim 1, wherein sealing covers are arranged at front and rear ends of the water sealing bearing.

7. The electric centrifugal pump of claim 1, wherein a spring washer is arranged between a rear end of the water pump impeller and the front end surface of the front bearing of the motor rotor.

8. The electric centrifugal pump of claim 1, wherein a leading impeller cover is arranged in a rear end opening of the leading impeller.

* * * * *